United States Patent [19]

Varner et al.

[11] 4,125,268

[45] Nov. 14, 1978

[54] CAM-ACTION AXLE CARRIER APPARATUS

[76] Inventors: David O. Varner, 4657 Vista De La Tierra, De Mar, Calif. 92014; Sherman E. DeForest, 1127 Cornish, Encinitas, Calif. 92024

[21] Appl. No.: 792,117

[22] Filed: Apr. 29, 1977

[51] Int. Cl.[2] ..... A63C 17/02

[52] U.S. Cl. ..... 280/11.28

[58] Field of Search ..... 280/11.28, 11.19, 11.23, 280/11.26, 11.27, 87.04 A

[56] References Cited

U.S. PATENT DOCUMENTS

| | | | |
|---|---|---|---|
| 329,556 | 11/1885 | Hirt | 280/11.28 |
| 3,331,612 | 7/1967 | Tietge | 280/11.28 |
| 4,047,725 | 9/1977 | Pinchock | 280/11.28 |

*Primary Examiner*—Joseph F. Peters, Jr.
*Assistant Examiner*—Gene A. Church
*Attorney, Agent, or Firm*—Arthur V. Doble

[57] ABSTRACT

A Cam-action axle carrier apparatus for use with a wheeled vehicle which depends for its steering function upon the rolling or tilting of its bed around a longitudinal axis. The cam-action axle carrier apparatus includes a support member inclined with respect to the vertical, and consisting substantially of a segment of a cylinder having a conical, lower cam surface with intersecting axes and is constrained to roll along an axle member by means of a cycloidal cam coincident with the turning axis of the vehicle, the axle member being connected to a retention plate which is held in cooperative association with the inclined support member. The steering action of the wheeled vehicle is generated by the conical cam peripheral surface rolling over the upper surface of the axle member in response to the vehicle's bed being tilted by the rider. The conical cam rolling along the axle carries the vehicle bed and rider toward the center of turn, maintaining the geometric roll center near the road surface and keeping the total load force vector near the axle center.

14 Claims, 16 Drawing Figures

FIG. 6.
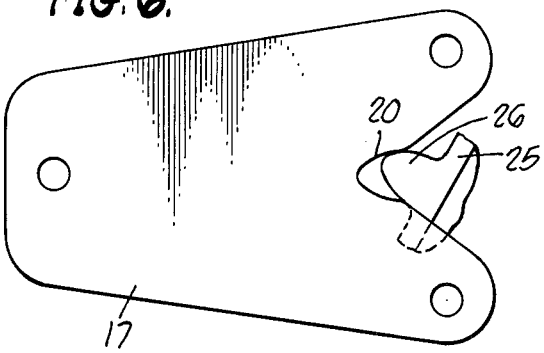
FIG. 5.
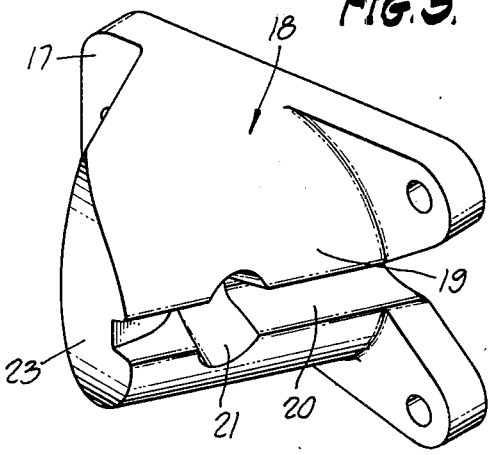
FIG. 3.
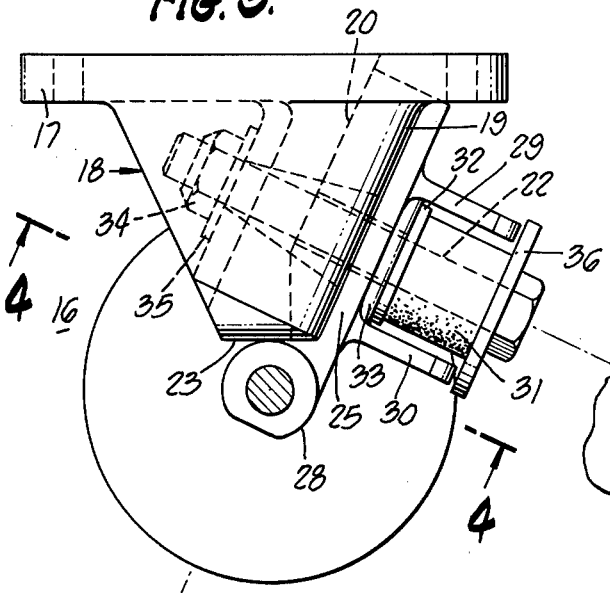
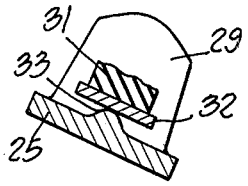
FIG. 9.
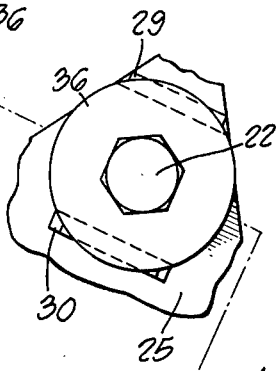
FIG. 7.
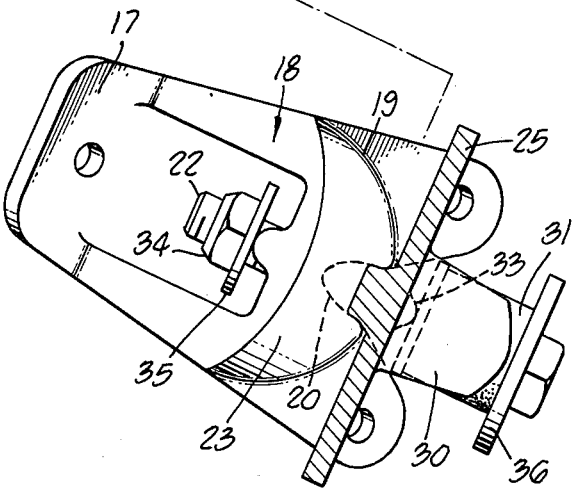
FIG. 4.
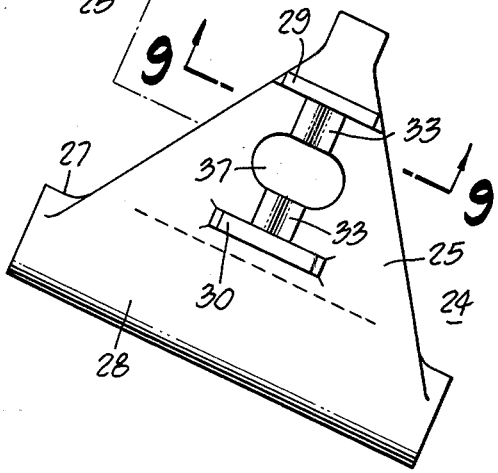
FIG. 8.

CAM-ACTION AXLE CARRIER APPARATUS

BACKGROUND OF THE INVENTION

1. Field of the Invention

This invention relates to apparatus of the cam-action axle carrier apparatus tye for application generally to any wheeled vehicle which depends for its steering function upon the rolling or tilting of its bed around a longitudinal axis. It more particularly applies to a cam-action axle carrier apparatus for use with small vehicles such as skateboards, carts, scooters or roller skates.

2. Description of the Prior Art

Various forms of skateboard-type axle carriers have been in use for many years. Among the earliest structures of this type known to applicant is that found in U.S. Pat. No. 115,767, issued on June 6, 1871 to Oakley, whose invention disclosed what is still a common practice on many contemporary skateboards and other small wheeled vehicles of this type. That practice is to obtain or achieve an induced steering action in such vehicles by inclining the steering axis or axes at some angle with respect to the vertical whereupon the reaction of the road surface to the tilting of this axis about a longitudinal axis induces a rotation of the axle in such a way as to alter the travel direction of the vehicle.

The following additional patents represent the most pertinent art known to applicants and clearly illustrate the novelty of applicant's invention:

U.S. Pat. Nos.: 3,331,612, 299,799, 215,081, 199,009.

Each of these patents discloses the need for improved axle carrier structures for facilitating steering of these types of vehicles. These prior patents disclosed improvements in axle carrier structures including geometric, functional and material considerations but each appeared to implement the above described common practice to induce steering action by inclining the steering axis at an angle with respect to the vertical to induce axle rotation through reaction of the road surface to the tilting of the steering axis about a longitudinal axis in an inadequate manner while retaining a high center of roll.

Closer examination of the known prior art disclosed that none of these structures have shown suitability for use as a highly stable device having a low roll axis for providing more responsive steering and better load distribution such as is provided for in applicants' invention.

SUMMARY OF THE INVENTION

Applicants herein have conceived of a cam-action axle carrier apparatus for use with wheeled vehicles such as skateboards, roller skates, scooters, carts and other related vehicles. This axle carrier apparatus has members inclined to the vertical, one of which consists substantially of a segment of a cylinder having a conical, cam surface lower end whose axis intersects that of the cylinder, the conical cam surface being adapted to roll along the axle in conjunction with the action of a cycloidal cam coincident with the turning axis of the vehicle. The steering action of the wheeled vehicle is facilitated by the upper face of the axle housing rolling relative to the conical peripheral cam surface in response to the vehicle's bed being tilted by the rider. During this steering action, the cam surface rolling with respect to the axle housing carries the vehicle bed and rider toward the center of turn. This motion maintains the geometric roll center near the road surface and keeps the total load force vector near the axle center.

As a result both stability and directional control are improved over those obtainable by the conventional steering arrangement of prior art devices.

As in conventional carriers of this type, steering forces are generated as a function of the rider's weight reacted by the road surface through the carrier of this invention also. However, these forces are, in applicants' invention, applied directly to the axle as the conical cam surface rolls thereupon, such action hereinafter being referred to as "cam-action." Since the rider's weight is reacted directly by the two axles of a typical small wheeled vehicle in this manner a more direct, positive and responsive steering results.

The steering action of applicants' invention is also faster than is conventional because of a lesser inclination of the steering axis. In conventional carriers this axis is inclined from 30° to 45° from vertical while in applicant's invention the axis is inclined only 25°. The 25° inclination is achieved without becoming too sensitive or requiring too much torque because of the directly applied rolling force as described above.

Because the wheel axis of a conventional carrier is off-set from the steering axis so that it leads into the turn, the rider's weight is shifted in the opposite direction away from and to the outside of the turn. Geometry of the applicants' carrier is such that the axle follows the steering axis into a turn and the rider's weight is shifted by the cam rolling along the axle in the direction of and towards the inside of the turn. This action also tends to keep the resultant load near a point midway between the wheels.

With respect to damping action, like in conventional carriers, the reaction of loads as indicated by the geometry is modified by the dampening action of rubber bushings or metal springs. Generally, applicants have found that the less stiffness required of the dampers, the more effective the geometry in determining performance of the vehicle.

The trailing edge of applicants' two carriers used on a skateboard achieves a more stable steering action in either direction of travel and so requires a less stiff damper to prevent undesirable oscillations about the steering axis which might otherwise be present.

This means that the true resultant reaction of loads coincides more nearly to that described by the geometry.

It is accordingly an object of this invention to provide a cam-action axle carrier apparatus which improves the steering action and general performance of carriers for use on skateboards and the related like by lowering the roll axis of such vehicle to provide more responsive steering, better distribution of load and improved stability.

It is a further object of this invention to provide a cam-action axle carrier apparatus which improves the steering action and general performance of axle carriers for use on skateboards and the related like by orienting the axle in such a way that the principal vectoral force of the rider's weight is shifted toward the inside of a turn rather than toward the outside as is the general case in known conventional prior trucks.

It is also an object of this invention to provide a cam-action axle carrier apparatus to improve the steering action and general performance of skateboards and the related like by minimizing dependence on rubber dampers or snubbers to achieve directional stability.

It is still a further object of this invention to provide a cam-action axle carrier apparatus that is economical to manufacture and use, as well as being durable, rugged, reliable and easy to operate, clean and adjust.

For a better understanding of this present invention, together with other and further objects thereof, reference is made to the following description taken in connection with the accompanying drawings in which a preferred embodiment of the invention is illustrated, the scope of this invention being pointed out and contained in the appended claims.

BRIEF DESCRIPTION OF THE DRAWINGS

FIG. 3 depicts a side view of one embodiment of a cam-action axle carrier apparatus.

FIG. 4 is a sectional view of the axle carrier apparatus along line 4—4 of FIG. 3.

FIG. 5 is a perspective view of the support member showing its cylindrical surface, its conical lower surface, its cycloidal groove and its tapered hole for accommodation of a retaining bolt.

FIG. 6 is a view of the base mounting plate including a segmented view of the cyclodial tooth portion of an axle retainer engaged in the upper end of the cycloidal groove in an end of the base mounting plate.

FIG. 7 is an end view of the retaining bolt, washer and flanges of the axle retainer.

FIG. 8 is a front view of the axle retainer.

FIG. 9 is a sectional view including the rubber damper bushing along line 9—9 of FIG. 8.

DESCRIPTION OF THE PREFERRED EMBODIMENT

Figure 1:
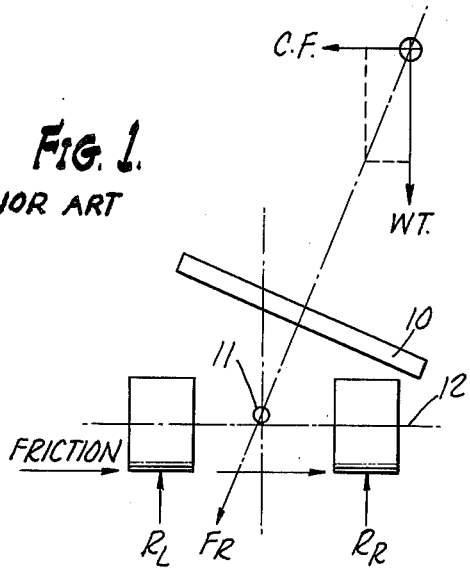
FIG. 1. PRIOR ART
FIG. 1 schematically depicts the relative position of a tiltable bed, the roll center and the wheel axis in a conventional type skateboard apparatus.

In FIG. 1 there is shown schematically the relative position of a tiltable bed 10, the roll center 11 and the wheel axis 12 in a conventional small wheeled vehicle such as a skateboard during a turn. Vectoral forces acting thereon are also shown. C.F. is centrifugal force. WT is weight. $R_L$ is the reaction force on the left wheel. $R_R$ is the reaction force on the right wheel. $F_R$ is the resultant force of the combined forces of C.F. and WT. The location of the roll center 11 is relatively high and relative instability results therefrom during turning motion of the skateboard using a conventional axle carrier apparatus.

Figure 2:
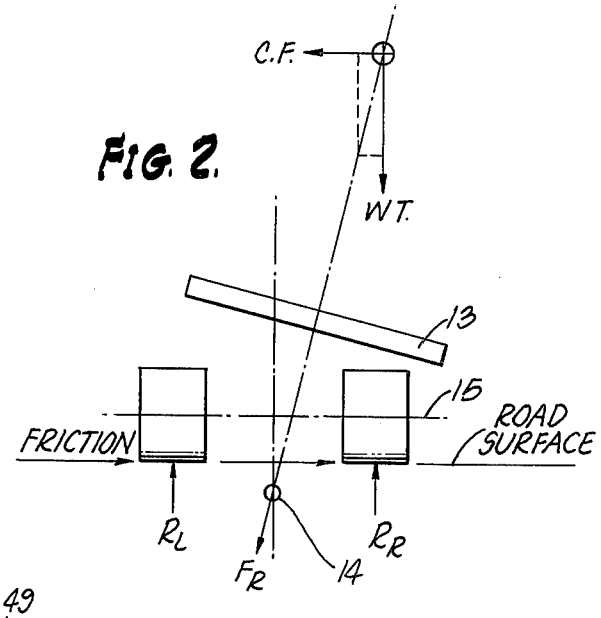
FIG. 2 schematically depicts the relative position of a tiltable bed, the lower roll center and the wheel axis in applicants' apparatus.

In FIG. 2 there is shown schematically the relative position of a tiltable bed 13, the roll center 14 and the wheel axis 15 of applicants' apparatus. Vectoral forces acting thereon are likewise shown. Abbreviations for forces in this picture are the same as in FIG. 1. It is shown that the location of the roll center 14 is much lower than that of the conventional skateboard and it produces a greater degree of riding stability than exists in the conventional skateboard.

In FIG. 3 there is a preferred embodiment of this cam-action axle carrier apparatus. At 17 there is shown a rigid base mounting plate which may be fastened by any convenient suitable means to the bed or frame of a wheeled vehicle such as may be found on a typical skateboard. Integrally connected to plate 17 and inclined at an angle of 25° is support member 18 which serves as the main supporting portion of the apparatus 16. FIG. 4 includes a sectional view of support member 18. At 19 there is shown the contour of the cylindrical surface face of member 18. At 20 there is shown a cycloidal-shaped groove which is parallel to the longitudinal axis of the cylindrical surface 19 of member 18. In FIG. 5 a perspective view of a major portion of member 18 is presented in further detail. A conically tapered hole 21 is provided for accommodation of retaining bolt 22 shown in FIG. 3. The lower surface 23 of member 18 is conical, the axis of which intersects the longitudinal axis of the member 18 defined by the cylindrical surface 19. In this embodiment, particularly referring to FIGS. 8 and 6, the axle retention means 24 having a movable plate 25 and longitudinal tooth 26 is shown in cooperative contact with support member 18. By reference to FIG. 6 the longitudinal tooth 26 having a cyclodial-shaped cross-section and being integral with plate 25 is shown in contact with cycloidal-shaped groove 20 of member 18, which extends into plate 17, in a plate 17-turned position. As base mounting plate 17, which is connected to the tiltable bed of a vehicle is tilted the tooth 26 will track in cycloidal-shaped groove 20 to an extent determined by the degree of tilt of the vehicle's bed and plate 17. This action results in plate 25 rotating about cylindrical surface 19. The upper surface 27 of axle member 28 of axle retention means 24 is flat and is in rollable contact with the conical surface 23 of member 18. As plate 25 rotates due to the tilting action of plate 17, and member 18, tooth 26 of axle retention means 24 also rotates correspondingly in groove 20 and upper surface 27 of axle member 28 retains contact with conical surface 23 which facilitates the roll of the tiltable bed of the vehicle due to the configuration of conical surface 23. In this embodiment, means for retaining axle retention means 24 in cooperative association with the support means includes within flanges 29 and 30, which are integral with plate 25, resilient means for damping forces generated between the axle retention means 24 and the support member 18, the resilient means being in this embodiment a resilient damper 31 which is partially housed between flanges 29 and 30 and which may be most conveniently a rubber bushing to provide a spring-like damping action. Alternate suitable materials such as a coiled spring may also be used. Said means for retaining the axle retention means 24 also includes washer 32 which is located at the inner end of damper 31 between flanges 29 and 30 and is pivotable, in conjunction with the motion of bolt 22 and damper 31, about bead 33 which is integral with plate 25, as may be seen from FIGS. 8 and 9.

A self-locking nut 34 and washer 35 are also a part of the means for retaining the axle retention means 24 in cooperative association with support member 18 and are employed to retain bolt 22 in operational position. Washer 36 is placed below the head of bolt 22 adjacent to damper 31. A normal running clearance of 0.030 is generally maintained between washer 36 and flanges 29 and 30 about which it rotates in conjunction with movement of bolt 22.

In FIG. 8 there is shown a slotted hole 37 in plate 25 through which bolt 22 is placed when the apparatus 16 is in an operational condition as shown in FIG. 3.

Figure 10:
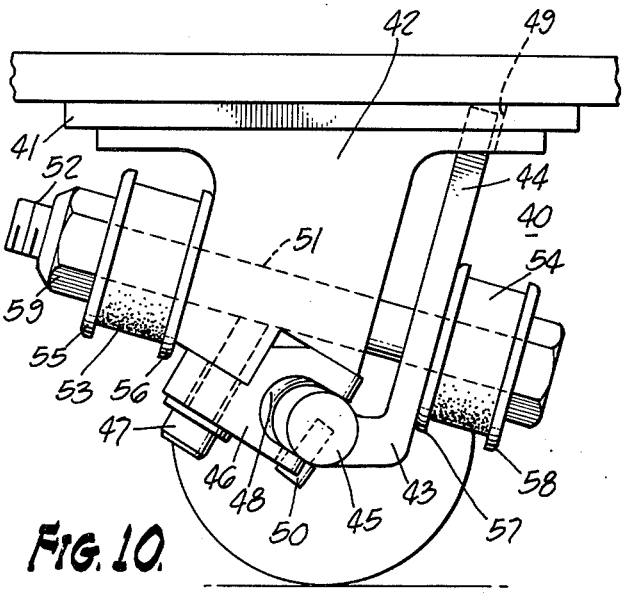
FIG. 10 depicts another embodiment of applicants cam-action axle carrier apparatus.
Figure 11:
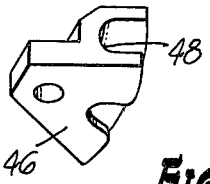
FIG. 11 is a perspective view of the cam segment member which may also be seen in its side view in FIG. 10.

In FIG. 10 there is shown an alternate embodiment of this invention. At 40 there is shown an apparatus having a base mounting plate 41 and integrally connected inclined support member 42. Axle retention means 43 which in this embodiment has a movable retainer plate 44 and axle member 45 is arranged as shown for cooperation with the support means consisting in this embodiment of member 42 and cam segment 46. Cam segment 46 is shown in a perspective view in FIG. 11 and may be attached to member 42 as shown in FIG. 10 by any convenient means such as a screw 47. Axle member 45 is induced to turn upon tilting of plate 41, member 42 and cam segment 46 as axle member 45 follows slot 48 of cam segment 46 and cam segment 46 rolls along the axle member 45. The upper end of plate 44 is adapted and arranged to fit into a slot 49 of base mounting plate 41. Pin 50 may be positioned in axle member 45 for support purposes. Pin 50 is constrained by the cycloidal notch of cam 46 thus forcing the axle retainer to roll rather than sliding in the cam groove 48. A tapered slot 51 is located in member 42 to receive a retaining bolt 52 which is employed to hold plate 44, axle member 45, cam segment 46 and member 42 in proper relative operational position as shown. Tapered slot 51 has its smallest end closest to washer 56 and permits side-to-side motion of the bolt 52 during a turn. Resilient means for damping forces include resilient dampers 53 and 54 which are placed on the bolt 52 as shown and which are retained in place, repectively, by washers 55 and 56 and washers 57 and 58. Nut 59 is positioned and tightened onto the end of retainer bolt 52. Another alternate embodiment of this invention may be described as being the same as that found in FIG. 10 but omitting damper 54 and washers 57 and 58.

Figure 12:
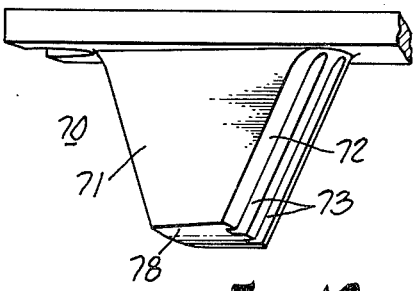
FIG. 12 is a perspective view depicting the principal support member and mounting plate of yet another embodiment of applicants invention particularly showing its lower conical surface and elongated grooves.
Figure 13:
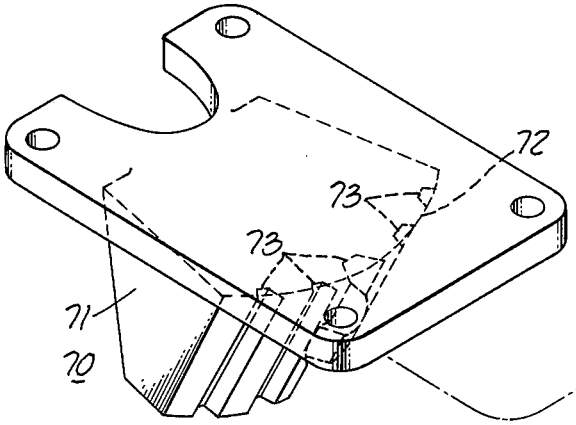
FIG. 13 is a perspective view of the same support member and mounting plate of that shown in FIG. 12 from a higher elevation.
Figure 14:
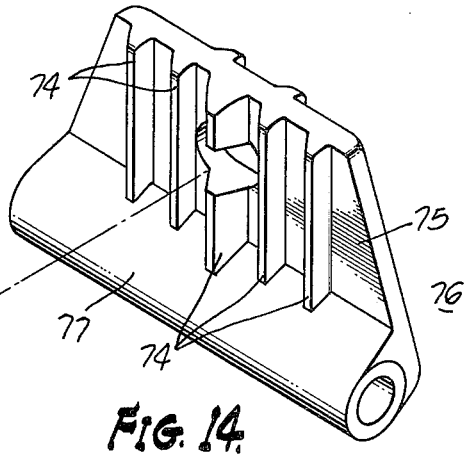
FIG. 14 is a perspective view of the axle retainer and plate having teeth which are constructed to mesh with the grooves in FIG. 13.

Members of a further embodiment of this invention are shown in FIGS. 12, 13 and 14 wherein at 70 there is shown support means having an inclined support member 71, member 71 having a cylindrical surface 72 which has a plurality of grooves 73 arranged thereupon and parallel to the longitudinal axis of the cylindrical surface 72 and adapted to receive respectively one or more of a plurality of teeth 74 which are properly aligned to make cooperative contact with said grooves 73, the teeth 74 being integrally formed with plate 75. In this embodiment the axle retention means 76 includes plate 75 and axle member 77 which is integral with plate 75. The lower conical surface 78 of member 71 is adapted for rollable contact with the top of axle member 77, and as member 71 is tilted, axle member 77 is caused to turn. Member 71 and axle retention means 76 may be retained in cooperative positions by any convenient means such as by the use of retaining and associated hardware of the type shown in FIG. 10.

Figure 15:
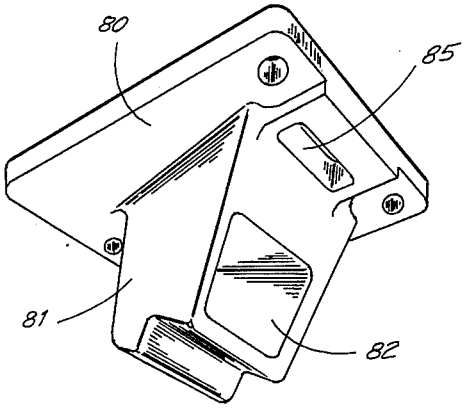
FIG. 15 is a perspective view of a support member and base mounting plate of another embodiment of the present invention.
Figure 16:
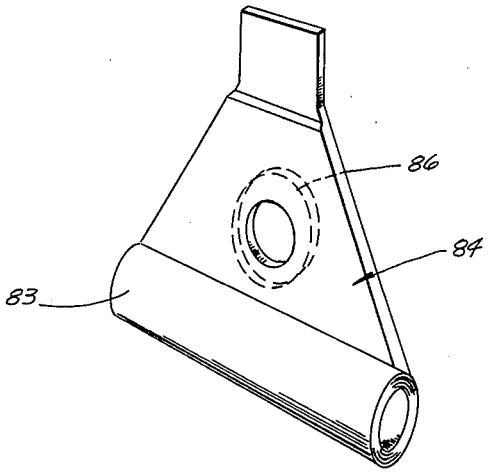
FIG. 16 is a perspective view of an axle retention means for use with the support member of FIG. 15.

In FIG. 15 there is shown a perspective of a portion of another embodiment of this invention which has a base plate 80 and a portion of a support means comprising an inclined support member 81 having a rectangular opening 82 which facilitates nominal movement of a retaining bolt of the type shown at 52 in FIG. 10. The support means further comprises a cam segment of the type shown at 46 in FIG. 11. The embodiment of FIG. 15 is used in conjunction with axle retention means shown in FIG. 16 comprising axle member 83 and plate 84 which are integrally connected. The upper end of plate 84 is rectangular shaped to enable it to be operably and supportably placed in rectangular opening 85 of plate 80. In this embodiment, a recessed surface 86 is located on the back side of plate 84 to receive a washer positioned on the aforesaid bolt which is used to retain the axle retention means of FIG. 16 in cooperative association with the support means shown, in part, in FIG. 15.

What is claimed as new is:

1. Apparatus for use in turning an axle of a small wheeled vehicle having a bed tiltable by a rider for providing a steering function such as that found on a skateboard or the like, said apparatus comprising:

a. axle retention means for retaining the axle and for controlling the turning motion of the axle;

b. a base mounting plate connected to the tiltable bed of the vehicle;

c. support means for supporting the tiltable bed and plate over the axle retention means, the support means being connected at one end to the base mounting plate, the support means being adapted for rolling contact with the axle retention means to provide a low roll center of the bed and to keep the total load vector near the center of the axle during a turn of the vehicle; and d. means for retaining the axle retention means in cooperative association with the support means and base mounting plate.

2. The apparatus of claim 1 wherein the support means comprises a support member connected to the base mounting plate, the support member having a conical segment at its lower end, the longitudinal axis of the conical segment intersecting the longitudinal axis of the support member, the conical segment being adapted for rolling contact with the axle retention means, the axis of the conical segment being oriented to facilitate a turning motion of the axle retention means in response to the force thereon produced by the weight of the rider on the tiltable bed.

3. The apparatus of claim 2, wherein the support means comprises a support member having a cylindrical surface at one side of said member, the surface being substantially parallel to the longitudinal axis of the support member.

4. The apparatus of claim 3, wherein the support member has a cycloidal-shaped groove in the cylindrical surface of the support member, the groove being substantially parallel to the longitudinal axis of the support member and the cylindrical surface.

5. The apparatus of claim 4, wherein the axle retention means comprises a movable plate adapted for cooperative association with the support member, the plate having an integral, cycloidal-shaped cross-section tooth whose length substantially corresponds to and is adapted to make cooperative contact with the cycloidal-shaped groove of the support member, and an axle which is connected to the plate.

6. The apparatus of claim 5, further comprising resilient means for damping forces generated between the axle retention means and the support means while the apparatus is in use by a rider.

7. The apparatus of claim 6, wherein the resilient means for damping forces comprises a rubber bushing.

8. The apparatus of claim 6 wherein the resilient means for damping forces comprises a coil spring.

9. An apparatus for use on a small wheeled vehicle having a bed tiltable by a rider for providing a steering function such as that found on a skateboard or the like, said apparatus comprising:

a. a base mounting plate cooperatively associated with the tiltable bed of said vehicle;

b. axle retention means for retaining the axle and controlling the turning motion of the axle, the axle retention means having:

i. a movable plate;

ii. an elongated tooth having a cycloidal shaped cross-section integral with the movable plate; and iii. an axle which is integral with the movable plate;

c. a support member for supporting the tiltable bed and base mounting plate over the axle retention means, the support member consisting substantially of a segment of a cylinder having a conical surface at the lower end of the support member, the support member being connected to the base mounting plate, the support member further having a cycloidal-shaped groove in its cylindrical surface and substantially parallel to the longitudinal axis of the cylindrical, the length and cross-section of the groove substantially corresponding to that of the elongated tooth; and d. means for retaining the support member in rollable contact with the axle retention means;

whereby a steering function is produced upon tilting of the vehicle bed causing the conical surface at the lower end of the support member to roll along the axle causing it to turn in response to the force from the conical surface generated by the weight of a rider on the tilted bed.

10. The apparatus of claim 9 wherein the means for retaining the support member in rollable contact with the axle retention means comprises:

a. a retaining bolt which passes through respective aligned slots in the support member and plate;

b. resilient means for damping forces generated between the axle retention means and the support means, the resilient means being concentrically disposed around the retaining bolt near each end thereof;

c. a washer for supporting the bolt and resilient means, the washer being positioned on one end of the retaining bolt between the head of the bolt and said resilient means;

d. a washer for supporting the bolt and resilient means, the washer being positioned on the retaining bolt in close proximity to its outer end and adjacent to one end of said resilient means; and e. a fastening nut for keeping the bolt washers and resilient means in cooperative positions, whereby the support member is retained in rollable contact with the axle retention means.

11. The apparatus of claim 1, wherein the support means comprises a support member and a segment of a circular cam connected to the support member, the segement of said cam having a periphery which is grooved to fit over the axle, whereby the steering function is generated by the periphery of the segment of the cam rolling over the axle upon tilting of the vehicle and thereby causing the axle to turn.

12. The apparatus of claim 11, further comprising a pin for retaining the axle in positive contact with the periphery of the segment of the circular cam.

13. An apparatus for use in turning an axle of a small wheeled vehicle having a bed tiltable by a rider for providing a steering function such as that found on a skateboard or the like, said apparatus comprising:

a. a base mounting plate cooperatively associated with the tiltable bed of said vehicle, the plate having a substantially rectangular slot located near one of its ends;

b. axle retention means for retaining the axle and for controlling the turning motion of the axle, said axle retention means having:

i. a movable plate;

ii. an axle integral with the movable plate; and iii. a substantially rectangular tab connected to the movable plate and adapted for cooperative association with the slot in the mounting plate;

c. support means for supporting the tiltable bed and plate over the axle retention means, the support means being connected to said base mounting plate, the support means having:

i. a support member connected to the base mounting plate; and ii. a segment of a circular cam connected to the support member and having a peripheral surface which is grooved to fit over the axle; and d. means for retaining the axle retention means in cooperative association with the support means and base mounting plate.

14. An apparatus for use in turning an axle of a small wheeled vehicle having a bed tiltable by a rider for providing a steering function such as that found on a skateboard or the like, said apparatus comprising:

a. a base mounting plate cooperatively associated with the tiltable bed of said vehicle;

b. axle retention means for retaining the axle and for controlling the turning motion of the axle, the axle retention means having:

i. a movable plate;

ii. an axle connected to the movable plate; and iii. a plurality of elongated teeth, connected to the movable plate; and c. a support member for supporting the tiltable bed and plate over the axle retention means, the support means being connected to said base mounting plate, the support member having a cylindrical surface and a plurality of longitudinally-peripheral grooves in the cylindrical surface, the cross-sections of the grooves being substantially aligned with and corresponding to those of the elongated teeth on the axle carrier means, the support member further having a conical surface at its lower end and being adapted for rolling contact with the axle retention means; and d. means for retaining the axle retention means in cooperative association with the support member.

* * * * *